United States Patent [19]

Lukas et al.

[11] 4,272,935

[45] Jun. 16, 1981

[54] FIELD-INSTALLED INSULATION AND APPARATUS FOR AND METHOD OF MAKING AND INSTALLING THE SAME

[75] Inventors: Sidney Lukas, East Meadow; Timothy E. Golden, Islip; Patrick J. Lunarola, Massapequa; Michael G. Mard, Bohemia, all of N.Y.

[73] Assignee: Retro-Flex, Inc., Hempstead, N.Y.

[21] Appl. No.: 122,200

[22] Filed: Feb. 19, 1980

[51] Int. Cl.[3] ..... E04B 2/34; B29D 27/00

[52] U.S. Cl. ..... 52/309.11; 52/743; 118/24; 118/303; 264/31; 264/121; 264/123; 264/DIG. 7; 264/DIG. 10; 425/80.1

[58] Field of Search ..... 264/31, DIG. 10, 115, 264/123, 121, DIG. 7; 52/309.4, 404, 743, 749, 309.11; 118/303, 24; 425/80.1

[56] References Cited

U.S. PATENT DOCUMENTS

| | | | |
|---|---|---|---|
| 1,718,507 | 6/1929 | Wenzel et al. | 52/404 X |
| 1,849,945 | 3/1932 | Mobley et al. | 118/303 X |
| 1,854,100 | 4/1932 | Brito | 118/303 X |
| 2,200,713 | 5/1940 | Ericson | 52/404 X |
| 2,754,155 | 7/1956 | Kempthorne et al. | 118/303 X |
| 3,013,525 | 12/1961 | Fuller et al. | 118/303 X |
| 3,118,459 | 1/1964 | Stumpf | 118/303 X |
| 3,217,691 | 11/1965 | Jablonski | 118/303 |
| 3,358,059 | 12/1967 | Snyder | 52/743 X |
| 4,021,972 | 5/1977 | Choate et al. | 52/743 X |
| 4,198,485 | 4/1980 | Stark | 521/55 |

FOREIGN PATENT DOCUMENTS

| | | | |
|---|---|---|---|
| 1214942 | 12/1970 | United Kingdom | 52/404 |

*Primary Examiner*—Philip Anderson

*Attorney, Agent, or Firm*—Kirschstein, Kirschstein, Ottinger & Cobrin

[57] ABSTRACT

A thermally-insulating, non-flammable, air-permeable insulation for installation in the field, for example, in closed cavities between the walls of a house. A multitude of individually preformed, foamed plastic particles are initially entrained in a carrier stream, and thereupon drenched with a settable film-forming, non-flammable, liquid substance, such as a sodium silicate solution. The liquid substance sets to form a film which covers and adheres the particles to one another to form a thermally-insulating dense structural aggregate mass having structural integrity, resistance to fire, and venting capability. A method of making and installing the insulation, and a preferred apparatus therefor, are disclosed.

25 Claims, 3 Drawing Figures

FIELD-INSTALLED INSULATION AND APPARATUS FOR AND METHOD OF MAKING AND INSTALLING THE SAME

BACKGROUND OF THE INVENTION

1. Field of the Invention

The present invention generally relates to a method of, and apparatus for, making a thermally-insulating insulation for installation in the field and, more particularly, relates to a method of, and apparatus for, installing the thermally-insulating insulation and, yet more particularly, relates to the installed insulation itself which has novel thermally-insulating, non-flammable, venting and structural characteristics.

2. Description of the Prior Art

In order to conserve energy in residential, industrial or commercial buildings, many types of thermally-insulating materials and installation techniques have been proposed heretofore. However, the known materials and their installation have not proven altogether satisfactory.

For example, for retrofitting sidewalls, cellulose, mineral wool, or fiberglass have been blown into the closed cavity formed between the exterior and interior walls of a house by so-called "loose fill blown" techniques. These materials tend to settle due to gravity and pack down in time in the cavity, thereby leaving voids, through which heat can escape. Also, the particulate nature of these loose materials irritates the eyes, lungs and skin of the installer and generally requires him to wear a protective mask, gloves and goggles. Cellulose insulations also represent a fire hazard.

Fiberglass and mineral wool batting, as well as rigid boards have been used, but their installation requires extensive modification to the existing house structure, including, but not limited to, tearing down the walls of the house.

The so-called "foam-in-place" installation techniques introduce a composite stream of partially reacted monomers, e.g. urea and formaldehyde, into the closed cavity, whereupon the reaction is completed in the closed cavity. The urea-formaldehyde foam, however, does not necessarily fill the entire closed cavity during installation, and subsequently shrinks in the closed cavity and eventually deteriorates over time, thereby forming voids through which heat can escape. More importantly, the foam releases offensive-smelling gases which irritate one's mucous membranes and can cause such medical problems as headache, vomiting, and upper respiratory problems. Hence, occupants are eventually forced to leave their homes. In the event of fire, the urea-formaldehyde foam emits a toxic gas.

Another type of insulation material is expanded polystyrene bead insulation. The individual beads are freely blown into the closed cavity. However, the entire closed cavity is not necessarily filled by the loose beads, and the beads do not adequately present a fire barrier. Moreover, the blown-in beads shift and are subject to some settling within the closed cavity. In the event that electrical, plumbing or carpentry maintenance or like repairs are performed near a wall bounding a closed cavity in which the loose blown-in beads have previously been introduced, the beads roll out and empty from the closed cavity when the wall is removed. This "fall-out" problem is highly undesirable.

SUMMARY OF THE INVENTION

1. Objects of the Invention

Accordingly, it is the general object of the present invention to overcome the aforementioned drawbacks of the prior art.

Another object of the present invention is to provide a reliable thermally-insulating material which can completely fill a closed cavity formed between the walls of a building.

Still another object of the present invention is to provide a reliable thermally-insulating material which is resistant to fire.

A further object of the present invention is to provide a reliable thermally-insulating material which maintains its structural integrity and does not settle in the wall cavity.

An additional object of this invention is to provide a reliable thermally-insulating material which does not emit offensive odors.

Yet another object of this invention is to provide a reliable thermally-insulating material which can vent vapors therethrough.

Still an additional object of this invention is to provide a reliable thermally-insulating material which is water-repellant.

Yet a further object of this invention is to provide a reliable thermally-insulating material which will not rot.

A still further object of this invention is to provide a reliable thermally-insulating material which will not support bacterial growth and will not provide any nutrient value to plants and animals.

Still another object of this invention is to provide a novel apparatus for making the thermally-insulating material.

Yet still another object of this invention is to provide a novel apparatus for installing the thermally-insulating material.

Still an additional object of this invention is to provide a novel method of making the thermally-insulating material.

Yet another object of this invention is to provide a novel method of installing the thermally-insulating material.

2. Features of the Invention

In keeping with these objects and others which will become apparent hereinafter, one feature of the invention resides, briefly stated, in an apparatus for, and method of, making and installing thermal insulation for field installation, particularly in the closed cavities of the walls of residential, industrial, and commercial buildings, which comprise: means for conveying a carrier stream under pressure along a path; means for introducing a multitude of individually preformed, foamed plastic particles into the carrier stream for entrainment therein; means for substantially wetting the carrier-entrained particles by applying a settable film-forming liquid substance thereto to form a liquid-drenched dense but flowable mixture of said multitude of particles; and means for conveying the liquid drenched mixture further downstream along the path to the field installation area, i.e. the closed structural cavity.

In accordance with this invention, the settable liquid substance sets to form a set film about the particles. This set film covers and adheres the particles to one another at their common points of contact. This set film forms a structurally dense mass or aggregate of film-coated particles. The mass is structurally stable and resistant to particle disassociation due to the adhesion-like characteristic of the set film which imparts structural integrity to the entire mass. The mass does not crumble, or fracture or break apart into individual particles. This feature prevents any prior art settling problems which leave voids in the installed insulation through which heat may escape.

The set film is also non-flammable and therefore the set film which covers and adheres to the particles renders the entire mass resistant to fire.

The mass also has interstices located therein which are bounded by the irregularly-shaped particles at those points which do not physically contact each other. The interstices form maze-like tortuous air passageways which permit vapors to vent through the mass and permit the same to breathe.

The particles themselves are preferably expanded polystyrene particles which have excellent thermally-insulating properties. The settable liquid substance is preferably sodium silicate which takes on a quick, initial set and, subsequently, permanently sets with good adhesion-type, bonding characteristics.

Thermal insulation made, as described above, can reliably completely fill the wall cavity into which it is blown, does not settle in the wall cavity due to the above-described structural integrity, does not emit any offensive odors as was common with urea-formaldehyde foams, is water repellant and therefore will not encourage the growth of fungus or mildew, and makes an excellent acoustic barrier.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figures 1, 2, 3:
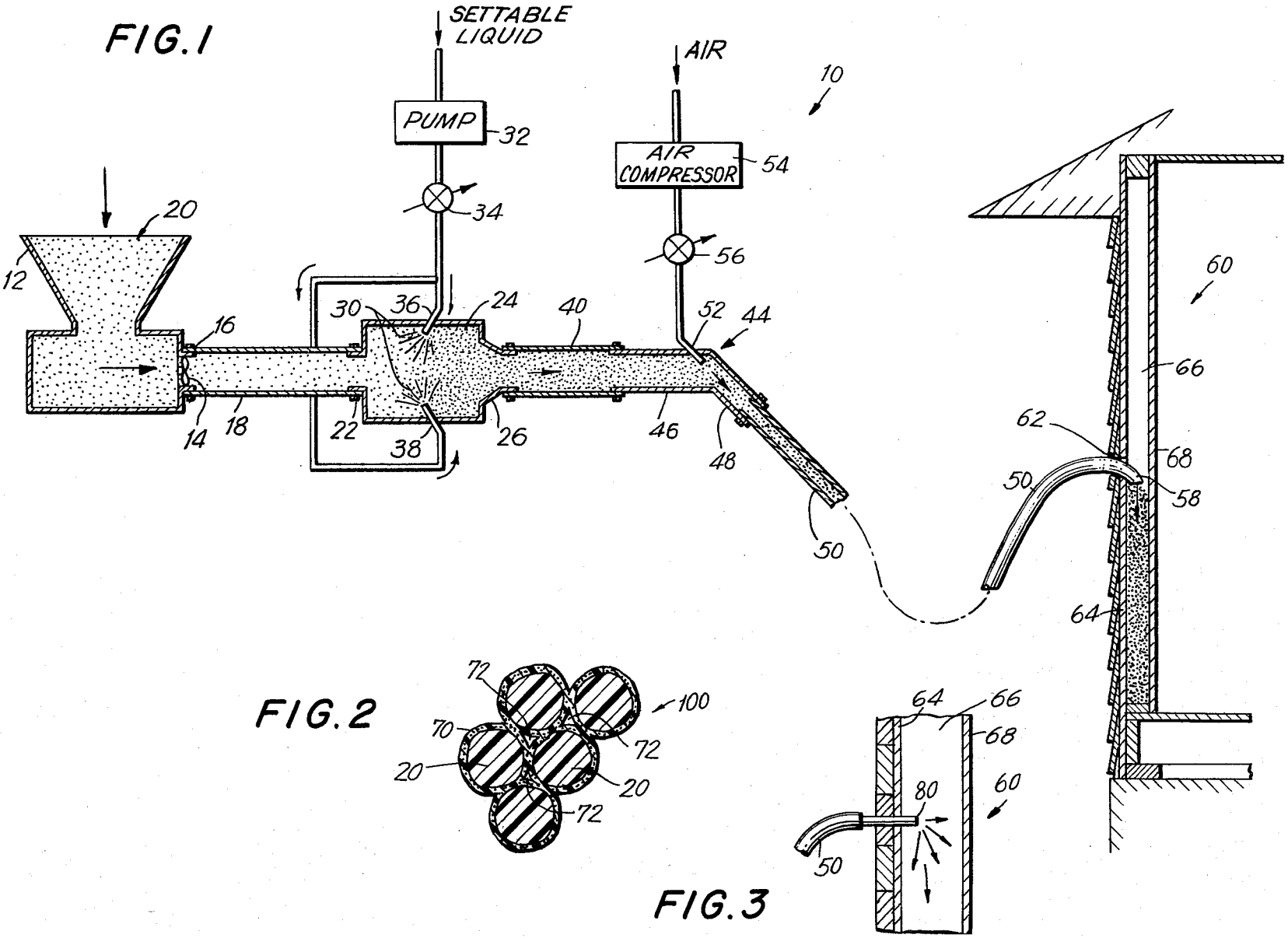
FIG. 1 is a diagrammatic view of the method of, and apparatus for, making and installing the thermal insulation for field installation in accordance with this invention.
FIG. 2 is a greatly enlarged cross-sectional view of a portion of the thermal insulation after installation in accordance with the method and apparatus of FIG. 1.
FIG. 3 is a detail view of an alternate method of installing the thermal insulation.

Referring now to FIG. 1 of the drawings, reference numeral 10 generally identifies the entire apparatus for making and installing the thermal insulation in accordance with the method of this invention. Reference numeral 100 in FIG. 2 identifies a greatly enlarged cross-sectional view of a portion of the thermal insulation itself.

Apparatus 10 comprises a gravity-feed hopper 12 having a discharge outlet 16. The inlet of an impeller-type blower 14 is connected to the discharge outlet 16. A large multitude of discrete individually pre-formed, foamed plastic particles 20 are introduced into the hopper, and are thereupon entrained in a pressurized carrier stream which is generated by the blower 14. This air stream pulls the particles 20 out of the hopper and discharges them to conduit 18. The bulk density of the particles 20 in the hopper is from about one to about two pounds per cubic foot. Preferably, the bulk density is about $1\frac{3}{4}$ lbs/ft$^3$ in the carrier stream.

In a preferred embodiment, the particles 20 are reground expanded polystyrene scrap. Typically, small pellets of polystyrene that contain a blowing agent are steam-heated. The heat expands the pellets to beads which are $\frac{1}{8}''$ to about $\frac{1}{4}''$ in diameter. After an aging period, the expanded beads are usually placed in a mold and reheated with steam to further expand them and fuse them into a large molded block. The block can be used as molded, or can be cut into board stock. The aforementioned scrap is the bits or pieces of leftover or discarded polystyrene produced during the molding or cutting operations. The term scrap can also mean the expanded beads themselves prior to placement in the mold. The scrap can be of the modified-type or of the non-modified type.

The discrete particles 20 are ground into random sizes and irregular shapes. The particles can be roughly characterized as being generally spheroids which have diameters on the order of 1/16". The expanded particles need not be polystyrene, but can be of any expandable plastic, such as polyethylene, polyacetal, cellulose acetate, cellulose acetate butyrate, just to mention a few possibilities.

The expanded polystyrene particles 20 have a generally uniform, closed cell structure which is highly resistant to heat flow and moisture penetration. The polystyrene particles will not rot, decay or support bacterial growth, and provide no nutrient value to plants or animals. The polystyrene has a high R value, at least on the order of 3.85/inch, and will reduce heat loss in block walls by more than 50%.

Returning to FIG. 1, the multitude of particles 20 are fed into the hopper 12 and are entrained in the air stream generated by the air blower 14. The air-entrained particles 20 are discharged from blower outlet 16 through a flexible conduit 18 to the inlet 22 of a wetting chamber 24.

A settable, film-forming, non-flammable liquid substance 30 is applied to the air-entrained particles 20 which flow through the wetting chamber 24 towards its outlet 26. The liquid substance 30 is supplied to a pump 32 for feeding the liquid substance to the wetting chamber 24. The pump 32 is preferably a P-15 type diaphragm pump which develops a pressure head of about 120 psi in normal operation. The adjustable valve 34 is operative to adjustably set the delivery rate of liquid substance to the chamber 24.

At least one, and preferably a pair of spray nozzles 36, 38 are mounted in the wetting chamber 24 at opposite sides of the stream of particles which flow through the chamber. Of course, any number of nozzles or analogous spraying means could be used. Each nozzle is preferably, but not necessarily, mounted at a 40° angle relative to the horizontally-extending stream. Each nozzle generates preferably a solid cone-type spray with uniform distribution and atomization throughout the entire spray pattern. The entire cross-section of the spray is filled with droplets of the liquid substance. A preferred spin-type atomizing nozzle can be obtained from the William Steinen Mfg. Co. of Parsippany, N.J. as model number SSM61.

The settable liquid substance 30 is a sodium silicate solution in which sodium oxide ($Na_2O$) and silica ($SiO_2$) are combined in varying proportions, usually with some water. Sodium silicate is also known as silicate of soda or as waterglass.

This proportion of $Na_2O$ to $SiO_2$ in sodium silicates is commonly expressed on a weight basis with the $Na_2O$ held at unity. The variations of the proportions of the constituents of sodium silicate are commercially expressed in terms of grades.

For example, a preferred grade of sodium silicate which is utilized as the settable substance 30 is grade 42 and is available from the Diamond Shamrock Company. Grade 42 is characterized by a 3.22 weight ratio of $SiO_2$ to $Na_2O$; a viscosity at 20° C. of 385 centipoises; a specific gravity at 20° C. of 1.415 (42.5° Baume); a weight per gallon of water of 11.78 pounds; and a solids content of 39.3%.

Other grades can likewise be used. For example, grades 34,49,50 and 52 could also be used. Grades 34,49,50 and 52 have weight ratios of 3.85, 2.58, 2.00, and 2.40, respectively. Grades 34,49,50 and 52 have viscosities at 20° C. of 206,630,335, and 1760 centipoises, respectively. Grades 34,49,50 and 52 have specific gravities at 20° C. of 1.312, 1.510, 1.526 and 1.559, respectively. Grades 34,49,50 and 52 have weights per gallon of water of 10.9, 12.58, 12.71, and 12.98 pounds, respectively. Grades 34,49,50 and 52 have solids contents of 32.5%, 44.5%, 44.1% and 47.3%, respectively.

The sodium silicate changes from a liquid to a semi-solid condition upon the loss of a small amount of water, and eventually changes to a solid condition upon the further loss of water. The sodium silicate takes on a quick, initial set which subsequently permanently sets.

The grade 42 sodium silicate is diluted in the proportion of about 1 quart of water to one gallon of sodium silicate before being fed to the pump 32. The grade 42 sodium silicate is also treated with a liquid wetting agent which spreads the sodium silicate out. The wetting agent is a surfactant-emulsifier and facilitates the wetting of the sodium silicate to the particles. The wetting agent also improves the non-flammability characteristic of the set, installed thermal insulation.

A preferred wetting agent is a blend of glycol and potassium oleate, e.g. Modicol-J which is commercially available from the Diamond Shamrock Company. About 0.5% to about 1% by volume of wetting agent to sodium silicate is preferred.

The above-described liquid composition of water, sodium silicate and wetting agent is fed to the spray nozzles 36,38 for substantially wetting the air-entrained particles in order to form a liquid-drenched mixture. The particles of the liquid-drenched mixture are densely spaced together; however, the liquid-drenched mixture is not so dense that it cannot flow along the path. The liquid-drenched mixture contains about from 25% to about 5% by weight of the above-described liquid composition to the particles.

The liquid-drenched mixture is discharged from the chamber outlet 26 which converges in downstream direction. The flared outlet 26 facilitates entry of the mixture into the outlet, and also slightly compresses the mixture during its travel through the outlet.

The liquid-drenched mixture is conveyed further downstream along the path through the flexible conduit 40. A generally V-shaped bent conduit 44 interconnects the flexible conduit 40 with the flexible filler hose or conduit 50. The bent conduit 44 has a tubular inlet arm 46 connected to the conduit 40, and a tubular outlet arm 48 connected to the conduit 50. The outlet arm 48 is angularly offset from the inlet arm.

A nozzle 52 is mounted on the inlet arm 46 and is oriented such that its discharge end is directed along the elongation of the angularly-offset outlet arm. Air is supplied to an air pump or compressor 54, and thereupon to an adjustable valve 56, before being fed to the nozzle 52.

In operation, the air pump 54 generates a pressure head on the order of 60 psi, and the pressurized air stream is rapidly directed through the discharge end of the nozzle 52. A Venturi-type effect is produced, whereby the pressurized air stream creates an overpressure condition in the outlet arm 48 which is operative for pushing the downstream portions of the mixture in the outlet arm 48 towards the filler conduit 50. Concomitantly, the pressurized air stream rapidly exiting the nozzle 52 creates an underpressure condition in the inlet arm 46 which is operative for pulling the upstream portions of the mixture in the inlet arm 46 towards the filler conduit 50. The adjustable valve 56 adjusts the delivery rate of the pressurized air stream, and thus the amount and rate of the mixture to be fed into the filler conduit 50.

The push-pull action described above is used to prevent jamming of the liquid-drenched mixture in the bent conduit 44. It will be recalled that the sodium silicate takes on a quick, initial set, and therefore, it is desirable to move the mixture downstream under pressure before the mixture sets and becomes immovable.

The filler conduit 50 is a flexible plastic hose about four feet to eight feet long and about one-half inch to about two inches in inside diameter. It is desired to pump the contents of the filler hose 50 to many types of field installation areas, as described below.

For example, FIG. 1 shows a method of pumping the contents of the filler hose 50 into a closed cavity formed between two sidewalls of a residential building to be retrofitted. The exterior wall 64 bounds an interior wall cavity 66 with an interior wall 68 of the building 60. The wall cavity 66 may not be strictly closed in an air-tight sense, but it is commonly known in the trade as a "closed" cavity.

The exterior wall 64 and interior wall 68 may be made of many types of materials. For example, the exterior and interior walls may both be made of brick, thereby forming a double brick cavity; or may both be made of wood, thereby forming a conventional double wall cavity; or may both be made of brick block, thereby forming a double brick block cavity.

Many other types of variations are possible. For example, a wooden or a brick or a block wall may be faced with stucco, or shingles, or the like. Or, only one row of hollow-core straight blocks can be used to form the building wall. Alternatively, mulitple walls can be erected, thereby forming triple brick cavities, for example.

In accordance with this invention, the term "closed cavity" is intended to cover all the above cases, including a cavity which is located between two or more walls, or is located within the hollow core of a single wall.

Turning back to FIG. 1, the discharge end 58 of the filler tube 50 is inserted with clearance through a fill hole 62 formed in the exterior wall 64. The fill hole 62 has a diameter slightly larger than the diameter of the filler discharge end so as to facilitate entry therein. The exterior wall 64 of the building is made of wood and has a shingle facing.

The method of installing the thermal insulation into the closed cavity 66 of FIG. 1 proceeds as follows: Once the liquid-drenched mixture is made as described above, and after the fill hole 62 is formed, the discharge end 58 is inserted through the hole 62. Thereupon the liquid-drenched mixture is blown into the closed cavity 66 under pressure so as to substantially fill up the entire space of the closed cavity 66. The flowable characteristic of the aggregate mixture of particles and liquid substance permits it to flow around pipes, electrical wiring and any other obstructions located in the closed cavity. The flowable nature of the mixture permits it to be conveniently blown into the closed cavity. The blowing process is controlled by the push-pull means described above, which permits the installer to control the quantity and filling rate. As shown in FIG. 3, when it is undesirable to form a fill hole of dimensions comparable to the filler hose, then a funnel-shaped adaptor 80 can be used. One end of the adaptor 80 is connected to the discharge end of the hose 50, and the opposite end of the adaptor is a cylindrical tube having a small diameter, typically on the order of $\frac{3}{4}$".

For example, if the exterior wall has a brick facing, then it is undesirable to form a large diameter fill hole therein. In this case, only a $\frac{3}{4}$" hole need be formed. The closed cavity behind the brick facing is filled as before.

Once the closed cavity is filled, the settable liquid subsequently sets to form a set film about the particles. As best shown in FIG. 2, the set film 70 covers and adheres the particles 20 to one another at their common points of contact. The set film 70 thus forms a structurally dense mass 100 of film-coated particles. The mass 100 is structurally stable and resistant to particle disassociation due to the adhesion-like characteristic of the set film 70 which imparts structural integrity to the entire mass 100. The mass 100 does not crumble into individual particles, and therefore does not settle and leave any voids through which heat may escape.

The set film 70 is also non-flammable, and therefore the set film 70 which covers and adheres to the particles renders the entire mass resistant to fire.

The mass 100 also has interstices 72 located therein. The interstices 72 are bounded by the irregularly-shaped particles 20 at those points which do not physically contact each other. The interstices 72 form tortuous air passageways which permit vapors on one side of the mass to pass through towards the other side of the mass. The mass can therefore "breathe," i.e. vent any undesirable vapors from the inside of the house 60 to the outside thereof.

The thermally-insulating properties of the polystyrene particles are derived from the particles themselves, as well as from the constituents of the liquid composition. In a preferred case, the R value lies in the range from about 3.85/inch to approximately 6/inch, but in some cases, can be greater than 6/inch.

The use of sodium silicate as the settable substance is particularly desirable from any energy conservation point of view due to the fact that it is a non-petroleum product.

The blowing-in of the liquid-drenched mixture means that walls do not have to be pulled apart for installation purposes. The thermal insulation of this invention can be installed in interior walls of a home, which was heretofore not done with ureaformaldehyde foams because of their pervasive odor. The thermal insulation can also be installed in mobile homes and boats without adverse effects.

The mass also serves as an effective acoustical barrier to dampen sound transmission through the walls of a building. The mass 100 also resists entry of moisture, and therefore prevents bacterial, plant or animal growth within the wall cavity.

It will be understood that each of the elements described above, or two or more together, may also find a useful application in other types of constructions differing from the types described above.

While the invention has been illustrated and described as embodied in field-installed insulation and apparatus for and method of making and installing the same, it is not to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. Method of making thermal insulation in closed cavities of field structures, comprising the steps of:
   (a) conveying a carrier air stream under pressure along a path to a wetting chamber;
   (b) introducing a multitude of individually preformed, foamed plastic particles into the carrier air stream for entrainment in the stream;
   (c) substantially wetting the carrier-entrained particles by applying a settable film-forming liquid substance thereto in the wetting chamber to form a liquid-drenched dense but flowable mixture of said multitude of particles;
   (d) pulling the drenched particles out of the wetting chamber in a second air stream, said conveying step and said pulling step jointly constituting a push-pull step; and
   (e) flowing the drenched particles in a second air stream via a filler hose to the closed cavities,
      said settable substance setting and forming a set film which covers and adheres said particles to one another at their common points of contact to form a structural thermally-insulating dense mass of said particles at the cavities,
      said structural thermally-insulating mass being structurally stable and resistant to disassociation of said individual particles due to the adhesion-like characteristic of said set film which provides structural integrity to the entire thermally-insulating mass.

2. The method as defined in claim 1, wherein said particle-introducing step is performed by introducing reground expanded plastic scrap into the air stream.

3. The method as defined in claim 1 wherein said wetting step simultaneously renders the carrier-entrained particles resistant to fire by wetting the particles with the settable liquid substance which is also non-flammable.

4. The method as defined in claim 1, wherein said wetting step is performed by utilizing a sodium silicate solution as the settable substance.

5. The method as defined in claim 4, wherein the wetting step is performed by utilizing as the settable substance a sodium silicate solution having a 3.22 weight ratio of $Na_2O$ to $SiO_2$, and about a 39.3% concentration of solids content to water.

6. The method as defined in claim 1, wherein said wetting step is performed by utilizing as the settable substance a sodium silicate solution, and by pretreating the latter with a wetting agent.

7. The method as defined in claim 1, wherein said wetting step includes drenching the carrier-entrained particles with the settable substance by heavily spraying the latter with sprays having a uniform distribution and atomization characteristic throughout the spray pattern.

8. The method as defined in claim 1; and furthr comprising the step of adjusting the delivery rate of the settable substance to the carrier-entrained particles.

9. The method as defined in claim 1, wherein said pushing and pulling steps include directing a pressurized carrier stream into the path of the liquid-drenched mixture; and further comprising the step of adjusting the delivery rate of the pressurized stream.

10. The method as defined in claim 1 for retro-fit installation, and further comprising the step of forming a hole in the structure which communicates with the closed structural cavity; and wherein the mixture is conveyed through said hole.

11. A thermally-insulating, non-flammable, air-permeable insulation installed in a field structure, said insulation being made and installed by the method of claim 1, said insulation comprising:

a multitude of individually pre-formed, foamed plastic, thermally-insulating particles; and a set film formed from a settable, film-forming, initially-liquid, non-flammable substance, said set film covering and adhering said particles to one another at their common points of contact to form a structural dense mass of said multitude of particles, said mass being structurally stable and resistant to disassociation of said individual particles due to the adhesion-like characteristic of said set film which provides structural integrity to the entire mass, said mass being resistant to fire due to the non-flammable characteristic of said set film which covers said particles, said mass having interstices bounded by said particles themselves at those points which are other than said contact points, and said interstices being air passageways which permit vapors on one side of the mass to pass through towards the other side of the mass in order to permit the entire mass to vent vapors therethrough.

12. The installed insulation as defined in claim 11, wherein said particles are reground, expanded, plastic scrap.

13. The installed insulation as defined in claim 11, wherein said film is set sodium silicate.

14. Apparatus adapted for making and installing thermal insulation in closed cavities of field structures, comprising:

(a) means for conveying a carrier air stream under pressure along a path to a wetting chamber;

(b) means for introducing a multitude of individual pre-formed, foamed plastic particles into the carrier air stream for entrainment in the stream;

(c) means for substantially wetting the carrier-entrained particles by applying a settable film-forming liquid substance thereto in the wetting chamber to form a liquid-drenched dense but flowable mixture of said multitude of particles;

(d) means to pull the drenched particles out of the wetting chamber in a second air stream, said conveying means and said pulling means jointly constituting a push-pull means; and (e) a filler hose through which the drenched particles are pulled in the second air stream to the closed cavities, said settable substance setting and forming a set film which covers and adheres said particles to one another at their common points of contact to form a structural thermally-insulating, dense, aggregate mass of particles at the cavities, said structural thermally-insulating mass being structurally stable and resistant to disassociation of said individual particles due to the adhesion-like characteristic of said set film which provides structural integrity to the entire thermally-insulating mass.

15. The apparatus as defined in claim 14, wherein said air stream-conveying means includes an air pump having an inlet, and wherein said particle-introducing means includes a hopper in communication with the inlet.

16. The apparatus as defined in claim 14, wherein said wetting means includes nozzle means for directing the settable liquid substance under pressure to the carrier-entrained particles.

17. The apparatus as defined in claim 16, wherein said nozzle means includes a pair of spray nozzles mounted on the wetting chamber and being directed at opposite sides of the path of the carrier-entrained particles.

18. The apparatus as defined in claim 17, wherein each spray nozzle is mounted on the wetting chamber at an angle relative to the path of travel of the carrier-entrained particles through the chamber.

19. The apparatus as defined in claim 16, wherein said nozzle means includes a spray nozzle for generating a solid cone-type spray with uniform distribution and atomization throughout the entire spray pattern.

20. The apparatus as defined in claim 3, wherein said wetting means includes means for adjusting the delivery rate of the settable substance to the carrier-entrained particles.

21. The apparatus as defined in claim 14, wherein said push-pull means includes a nozzle located in the path at a location intermediate the wetting means and the cavities, said nozzle being oriented relative to the path such that the push-pull means creates an overpressure condition downstream of the nozzle and concomitantly creates an under pressure condition upstream of the nozzle.

22. The apparatus as defined in claim 21, wherein said push-pull means includes a generally V-shaped conduit having an inlet arm and an outlet arm angularly offset from the inlet arm, and wherein said push-pull means includes pressure means for directing a pressurized stream through said nozzle, and wherein said nozzle is mounted in the conduit and has a discharge end which directs the pressurized stream through said angularly-offset outlet arm.

23. The apparatus as defined in claim 22, wherein said pressure means includes means for adjusting the delivery rate of the pressurized stream.

24. The apparatus as defined in claim 14, wherein said conveying means includes a flexible hose.

25. The apparatus as defined in claim 24; and further comprising an adaptor mounted on the flexible hose.

* * * * *